US009431711B2

(12) United States Patent
Guo et al.

(10) Patent No.: US 9,431,711 B2
(45) Date of Patent: Aug. 30, 2016

(54) BROADBAND MULTI-STRIP PATCH ANTENNA

(75) Inventors: Qidong Guo, Gurnee, IL (US); Adem Celebi, Oak Park, IL (US); Chris Lotesto, Prospect Heights, IL (US); Walter Harwood, Streamwood, IL (US)

(73) Assignee: SHURE INCORPORATED, Niles, IL (US)

( * ) Notice: Subject to any disclaimer, the term of this patent is extended or adjusted under 35 U.S.C. 154(b) by 590 days.

(21) Appl. No.: 13/601,011

(22) Filed: Aug. 31, 2012

(65) Prior Publication Data

US 2014/0062794 A1 Mar. 6, 2014

(51) Int. Cl.

| | |
|---|---|
| ***H01Q 1/38*** | (2006.01) |
| ***H01Q 9/04*** | (2006.01) |
| ***H01Q 5/378*** | (2015.01) |

(52) U.S. Cl.

CPC ..... *H01Q 9/0414* (2013.01); *H01Q 5/378* (2015.01); *H01Q 1/38* (2013.01)

(58) Field of Classification Search

USPC ..... 343/700 MS, 702

See application file for complete search history.

(56) References Cited

U.S. PATENT DOCUMENTS

| | | | | |
|---|---|---|---|---|
| 4,131,893 | A * | 12/1978 | Munson | H01Q 1/27 343/700 MS |
| 5,781,158 | A | 7/1998 | Ko et al. | |
| 6,675,461 | B1 * | 1/2004 | Rowson | H01Q 7/005 254/104 |
| 7,012,568 | B2 * | 3/2006 | Desclos | H01Q 1/38 343/700 MS |
| 7,551,142 | B1 * | 6/2009 | Zhang | H01Q 1/243 343/700 MS |
| 8,228,243 | B1 | 7/2012 | Rivera | |
| 2004/0233111 | A1 | 11/2004 | Desclos et al. | |
| 2011/0095947 | A1 * | 4/2011 | Chou | H01Q 9/0421 343/700 MS |

FOREIGN PATENT DOCUMENTS

| | | |
|---|---|---|
| WO | WO-03/003503 | 1/2003 |

OTHER PUBLICATIONS

Written Opinion for PCT/US2013/052185, mailed Aug. 1, 2014 (6 pages).

International Search Report for PCT/US2013/052185, mailed Nov. 4, 2013.

Written Opinion for PCT/US2013/052185, mailed Nov. 4, 2013.

(Continued)

*Primary Examiner* — Hoang V Nguyen
*Assistant Examiner* — Hai Tran
(74) *Attorney, Agent, or Firm* — Marshall, Gerstein & Borun LLP

(57) ABSTRACT

A system and method of providing a broadband patch antenna includes a main patch having a first strip and a second strip positioned about a ground strip extending from a ground plane, wherein at least a portion of the first strip of the main patch is disposed above the ground strip and forms a first radiating edge with the ground strip, and at least a portion of the second strip of the main patch is disposed below the ground strip and forms a second radiating edge with the ground plane. A parasitic patch is coupled to the main patch along at least a portion of a non-radiating edge of the main patch, and the parasitic patch includes a first strip and a second strip, wherein at least a portion of the first strip of the parasitic patch is disposed above the ground strip and at least a portion of the second strip of the parasitic patch is disposed below the ground strip.

30 Claims, 16 Drawing Sheets

(56) References Cited

OTHER PUBLICATIONS

G. Kumar et al., "Nonradiating Edges and Four Edges Gap-Coupled Multiple Resonator Broad-Band Microstrip Antennas," *IEEE Transactions on Antennas and Propagation*, AP-33(2):173-78 (Feb. 1985).
G. Kumar et al., "Directly Coupled Multiple Resonator Wide-Band Microstrip Antennas," *IEEE Transactions on Antennas and Propagation*, AP-33(6):588-93 (Jun. 1985).
C. Wood, "Improved Bandwidth of Microstrip Antennas Using Parasitic Elements," *IEE Proceedings H Microwaves, Optics and Antennas*, 127(4):231-34 (Aug. 1980).
N. Herscovici, "A Wide-Band Single-Layer Patch Antenna," *IEEE Transactions on Antennas and Propagation*, 46(4):471-74 (Apr. 1998).
K.M. Luk et al., "Small Rectangular Patch Antenna," *Electron. Lett.*, 34(25):2366-67 (Dec. 1998).
R. Chair et al., "Small Dual Patch Antenna," *Electron. Lett.*, 35(10):762-64 (May 1999).
Y-M. Jo et al., "Broad Band Patch Antennas Using a Wedge-Shaped Air Dielectric Substrate," in *IEEE Antennas and Propagation Society International Symposium*, Orlando, FL, 932-35 (1999).
C-K. Wu et al., "Broadband Microstrip Antenna with Directly Coupled and Parasitic Patches," *Microwave Opt. Technol. Lett.*, 22(5):348-49 (Sep. 1999).
C-L. Tang et al., "Broadband Dual-Frequency V-Shape Patch Antenna," *Microwave Opt. Technol. Lett.*, 25(2):121-23 (Apr. 2000).
K-L. Wong, "Compact and Broadband Microstrip Antennas," Chapters 7 & 8, 232-293 (John Wiley 2002).
R. Li et al., "Development and Analysis of a Folded Shorted-Patch Antenna with Reduced Size," *IEEE Transactions on Antennas and Propagation*, 52(2):555-62 (Feb. 2004).
I-F. Chen et al., "A Novel Reduced-Size Edge-Shorted Patch Antenna for UHF Band Applications," *IEEE Antennas and Wireless Propagation Letters*, 8:475-77 (2009).
J. Zhang et al., "Miniaturization of Multiple-Layer Folded Patch Antennas," in *EuCAP 3rd European Conference on Antennas and Propagation*, Berlin 3502-06 (2009).
Written Opinion for PCT/US2013/052185, mailed Oct. 28, 2014 (4 pages), 2014.
International Preliminary Report on Patentability for International Application No. PCT/US2013/052185, dated Dec. 15, 2014 (6 pages), 2015.
Office Action in Taiwanese Application No. 102127879 dated Aug. 6, 2015, with translation, 11 pages.

* cited by examiner

1000

| Antenna | Frequency range (MHz) | W (cm) | L (cm) | H (cm) | Patch size (cm x cm) |
|---|---|---|---|---|---|
| Example embodiment 1 | 470 – 790 | 17 | 17 | 3.3 | 11 x 9.3 |
| Example embodiment 2 | 680 – 980 | 11 | 11 | 2.4 | 7.5 x 6.5 |
| Conventional single resonator patch antenna | 500 | 63 | 57 | 3 | 30 x 26 |
| Conventional single resonator patch antenna | 800 | 46 | 40 | 3 | 18.8 x 14.8 |

*FIG. 10*

1100

| Antenna | Frequency range (MHz) | Realized gain (dB) | Directivity (dB) | Mismatch loss (dB) | Note |
|---|---|---|---|---|---|
| Example embodiment 1 | 470 – 790 | 0 – 4 | 2 – 6 | 2 | Simulated |
| Example embodiment 2 | 680 – 980 | ~ 2.5 | ~ 4 | 1.5 | Simulated |
| Conventional single resonator patch antenna | 500 | > 7 | > 7 | < 0.5 | |
| Conventional single resonator patch antenna | 800 | > 7 | > 7 | < 0.5 | |

*FIG. 11*

| Name | Theta | Ang | Mag |
|---|---|---|---|
| m1 | 0.0000 | 0.0000 | 2.9466 |
| m2 | -54.0000 | -54.0000 | -0.3621 |
| m3 | 58.0000 | 58.0000 | -3.2551 |
| m4 | 0.0000 | 0.0000 | 2.9466 |
| m5 | -48.0000 | -48.0000 | -0.1321 |
| m6 | 48.0000 | 48.0000 | 0.0220 |

| Name | Theta | Ang | Mag |
|---|---|---|---|
| m1 | 0.0000 | 0.0000 | 2.1630 |
| m2 | -54.0000 | -54.0000 | 0.1985 |
| m3 | 58.0000 | 58.0000 | -2.7483 |
| m4 | 0.0000 | 0.0000 | 2.1630 |
| m5 | -48.0000 | -48.0000 | -1.3829 |
| m6 | 48.0000 | 48.0000 | -1.5227 |

BROADBAND MULTI-STRIP PATCH ANTENNA

FIELD OF THE DISCLOSURE

The present disclosure relates generally to antennas and, more particularly, to multi-layer patch antennas.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Wireless communication requires the use of an antenna to transmit and receive electromagnetic signals. Several antenna types are available for a variety of purposes and the choice of selecting one type of antenna or another typically depends upon the particular application of the antenna. To select an antenna, various operating characteristics of the antennas may be evaluated and compared to determine the type of antenna that provides the most benefit or is best suited for a specific application.

Occasionally, one antenna having all or most of the desired operating characteristics for a particular application may not exist and there may be several antennas having varying combinations of favorable and unfavorable aspects. For instance, a small antenna with a low profile and a wide bandwidth may generally be preferred for modern wireless communication. A microstrip or patch antenna is a relatively inexpensive antenna that is capable of being easily integrated with many electronic devices. Although the patch antenna may feature a low-profile, its relatively large size (approximately one-half wavelength) and narrow bandwidth (approximately 5%) may be a disincentive for its use in some wireless applications. However, various techniques have been developed to significantly reduce the size of the patch antenna. For example, by shorting one edge of the patch antenna and/or folding the patch antenna over itself, a reduction to one-fourth its original size may be achieved. Unfortunately, reducing the size of the patch antenna in this manner may also significantly reduce its bandwidth, e.g., 1.3% fractional bandwidth. The bandwidth of current patch antennas is therefore too narrow for practical use in short to medium range wireless communication systems, e.g., wireless microphones, wireless audio monitoring systems, local wireless data networks, wireless medical devices.

SUMMARY

Example apparatus and methods to provide an antenna for use in a wireless system are herein described. In one example embodiment, the antenna includes a main patch, a parasitic patch, and a ground plane having a ground strip extending from the ground plane. The main patch includes a first strip and a second strip, wherein at least a portion of the first strip of the main patch is positioned above the ground strip and forms a first radiating edge with the ground strip, and at least a portion of the second strip of the main patch is positioned below the ground strip and forms a second radiating edge with the ground plane. The parasitic patch is coupled to the main patch along at least a portion of a non-radiating edge of the main patch. The parasitic patch includes a first strip and a second strip, wherein at least a portion of the first strip of the parasitic patch is disposed above the ground strip and at least a portion of the second strip of the parasitic patch is disposed below the ground strip.

If desired, the antenna may include a tuning strip directly coupled to the parasitic patch and the ground strip. The antenna may further include at least a portion of the first strip of the main patch and at least a portion of the first strip of the parasitic patch lie in a first plane, and at least a portion of the second strip of the main patch and at least a portion of the second strip of the parasitic patch lie in a second plane, wherein the first plane and the second plane are different and the first plane may or may not be parallel to the second plane. Additionally, a second parasitic patch may be coupled to the main patch along at least a portion of a second non-radiating edge of the main patch. The second parasitic patch includes a first strip and a second strip, at least a portion of the first strip of the second parasitic patch is disposed above the ground strip and at least a portion of the second strip of the second parasitic patch disposed below the ground strip. The main patch, first parasitic patch, and second parasitic patch each include a length and a width. The lengths of the main patch, first parasitic patch, and second parasitic patch may be the same or different, and the widths of the main patch, first parasitic patch, and second parasitic patch may be the same or different.

Another example embodiment of the antenna may include a flexible printed circuit board including the main patch and one or both of the first and second parasitic patches. The flexible printed circuit board is folded about the ground strip and a stiffener to support the flexible circuit board and may be attached to one or more supports. An alternative implementation of the antenna may include a plurality of printed circuit boards, wherein a first printed circuit board includes the first strip of the main patch and the first strip of one or both of the first and second parasitic patches, a second printed circuit board includes the ground strip, and a third printed circuit board includes the second strip of the main patch and the second strip of one or both of the first and second parasitic strips. A first connector operatively couples the first strip of the main patch to the second strip of the main patch and a second connector operatively couples the first strip of the parasitic patch to the second strip of the parasitic patch. If a second parasitic patch is used, a third connector operatively couples the first and second strips of the second parasitic patch. One or more spacers and one or more supports may be utilized to separate and arrange the first, second, and third printed circuit boards in a layered, low-profile configuration.

An additional example embodiment is directed to providing an antenna for use in a wireless system. The method includes providing a ground strip extending from a ground plane and providing a main patch including a first strip and a second strip. The method positions the main patch about the ground strip, wherein at least a portion of the first strip of the main patch is positioned above the ground strip and forms a first radiating edge with the ground strip, and at least a portion of the second strip of the main patch is positioned below the ground strip and forms a second radiating edge with the ground plane. The method couples a parasitic patch to the main patch along at least a portion of a non-radiating edge of the main patch, wherein the parasitic patch includes a first strip and a second strip, and wherein at least a portion of the first strip of the parasitic patch is positioned above the ground strip and at least a portion of the second strip of the parasitic patch is positioned below the ground strip. The method provides for adjusting the bandwidth of the antenna by performing one or more of the following steps: attaching a tuning strip between that parasitic patch and the ground strip, changing a size of the tuning strip, changing a position of the tuning strip between the parasitic patch and the ground strip, changing a position of a feeding pin; directly coupling the main patch to the parasitic patch; gap-coupling the main patch to the parasitic patch; adjusting a spatial relationship between a gap-coupled main patch and parasitic patch; maintaining a constant spatial relationship between the first strip of the main patch and the second strip of the main patch, maintaining a constant spatial relationship between the first strip of the parasitic patch and the second strip of the parasitic patch, varying a spatial relationship between at least a portion of the first strip of the main patch and at least a portion of the second strip of the main patch, varying a spatial relationship between at least a portion of the first strip of the parasitic patch and at least a portion of the second strip of the parasitic patch, varying a spatial relationship between at least a portion of the second strip of the main patch and a ground plane, modifying a width of the main patch to be different in comparison to a width of the parasitic patch, and modifying a length of the main patch to be different in comparison to a length of the parasitic patch.

BRIEF DESCRIPTION OF THE DRAWINGS

FIG. 10 is a table showing antenna sizes for several example embodiments of the broadband multi-strip antenna.

FIG. 11 is a table showing various antenna performance parameters for several example embodiments of the broadband multi-strip antenna.

Figure 1A:
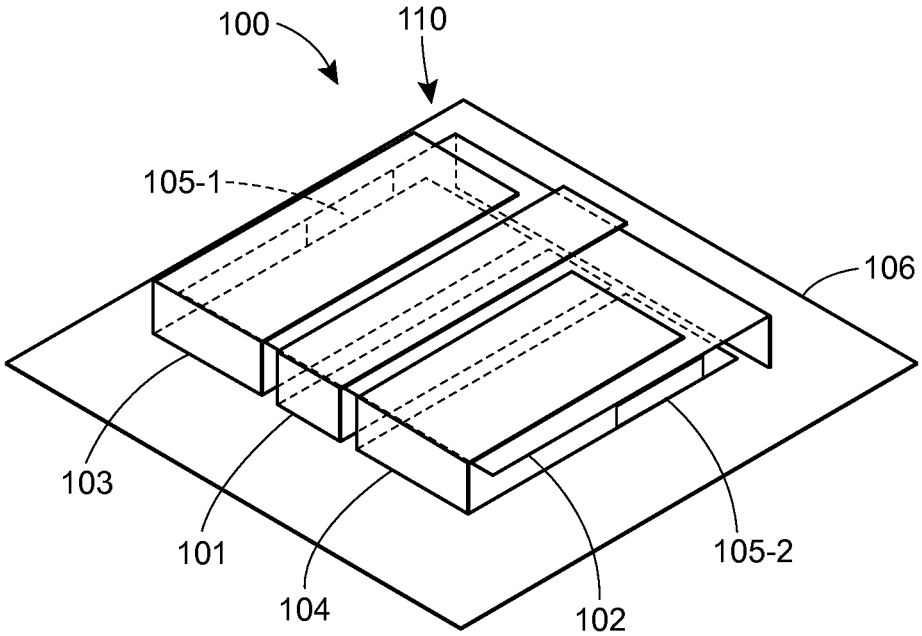
FIGS. 1A and 1B are perspective views illustrating one example of a broadband multi-strip antenna.

For purposes of clarification and ease of illustration, it is to be understood that certain portions of the several example embodiments of the antenna have been depicted in the figures in shading and/or hidden lines, which may or may not be present in other corresponding views and/or figures.

DETAILED DESCRIPTION

The disclosed apparatus and method provide for a low profile, compact, broadband antenna for use in modern wireless applications. In general, a multi-layer multi-strip configuration is utilized to overcome the known conflict in patch antenna design between size reduction and bandwidth broadening. In particular, the disclosed apparatus and method incorporate various combinations of a folded main patch with two radiating edges, one or more parasitic patches coupled to the main patch, and/or one or more shorting strips coupled between the one or more parasitic strips and a ground plane to achieve a significant size reduction in all dimensions and a significant broadening of the fractional bandwidth with respect to a conventional patch antenna.

FIGS. 1-6 generally depict an example broadband multi-strip antenna 100. More specifically, FIGS. 1A and 1B depict the antenna 100 including an antenna block 110 and a ground plane 106. The antenna block 110 includes a main patch 101 (shown highlighted in FIG. 2A) positioned about a ground strip 102 (shown highlighted in FIG. 3) extending from a ground plane 106. A feeding pin 203, shown in FIGS. 2A and 2B, extends through an opening in the ground plane 106 (see FIGS. 6B, 6C, and 6D) and is coupled to the main patch 101 to transfer energy to and from the antenna block 110.

The antenna block 110 further includes a first parasitic patch 103 (shown highlighted in FIG. 4A) coupled to the main patch 101 along at least a portion of a first non-radiating edge of the main patch 101, and a second parasitic patch 104 (shown highlighted in FIG. 4B) coupled to the main patch 101 along at least a portion of a second non-radiating edge of the main patch 101. One or both of the parasitic patches 103, 104 may also be directly coupled to the ground strip 102 by a tuning strip 105-1, 105-2 (shown highlighted in FIG. 5), respectively.

In the example embodiment shown in FIG. 1-6, the main patch 101 is positioned very close to the parasitic patches 103, 104 and is considered to be gap-coupled to the parasitic patches. In this gap-coupled configuration, there is not a direct coupling between the main patch 101 and the parasitic patches 103, 104 and surface current is therefore not able to flow between the main patch and the parasitic patches. However, because of the proximity of the parasitic patches 103, 104 to the main patch 101, RF energy is able to be transferred from the main patch 101 to the parasitic patches 103, 104 through the electromagnetic field that emanates from the main patch. Due to the gap coupling, the RF energy potential at the main patch 101 may be slightly different than the RF energy potential at each of the parasitic patches 103, 104. For example, the gap coupling between the main patch 101 and the parasitic patches 103, 104 may provide for amplitude and phase difference in RF energy potentials at the main patch and the parasitic patches. By adjusting the distance or spacing of the gap(s) between the main patch 101 and the parasitic patches 103, 104, it may be possible to attain certain amplitude and phase differences in RF energy potentials at the patches 101, 103, 104 and broaden the antenna's bandwidth.

Alternatively, the main patch 101 may be directly coupled to one or both of the parasitic patches 103, 104. In a direct coupling configuration, a conductor, e.g., conductive metal, connects the main patch 101 to one or both of the parasitic patches 103, 104. RF energy is propagated from the main patch 101 to the parasitic patches 103, 104 via the conductor and the RF energy potential at the point of coupling contact on the main patch may be very similar to the RF energy potential at the point of coupling contact on the parasitic patches. The location of the direct coupling determines the surface current pattern on the parasitic patches. By adjusting the location of the conductor that connects the main patch to the parasitic patches, it may be possible to attain a certain surface current distribution on the parasitic patches and broaden the antenna's bandwidth.

Figure 3:
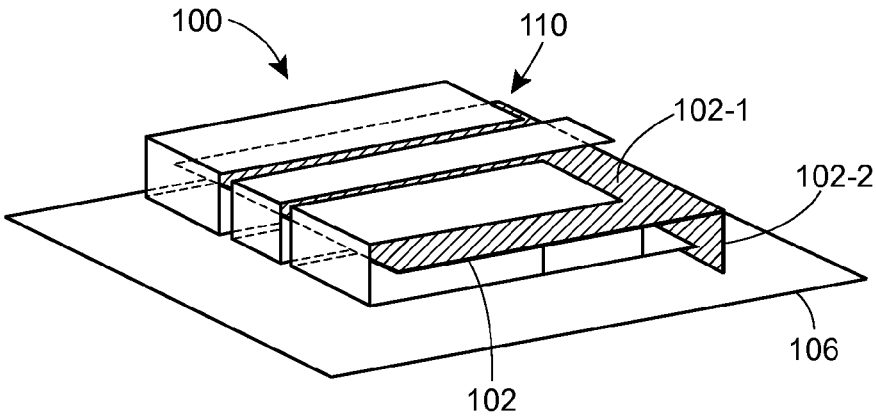
FIG. 3 is a perspective view illustrating the example broadband multi-strip antenna shown in FIGS. 1A and 1B wherein the ground strip is highlighted.

Referring briefly to FIG. 3, to provide direct coupling of the ground strip 102 to the ground plane 106, the ground strip 102 may include a horizontal portion 102-1 and a vertical portion 102-2. The horizontal portion 102-1 is disposed between the upper 101-1 and the lower 101-2 strips of the main patch 101 and the vertical portion 102-2 extends down from the horizontal portion 102-1 and couples the ground strip 102 to the ground plane 106.

Figure 2A:
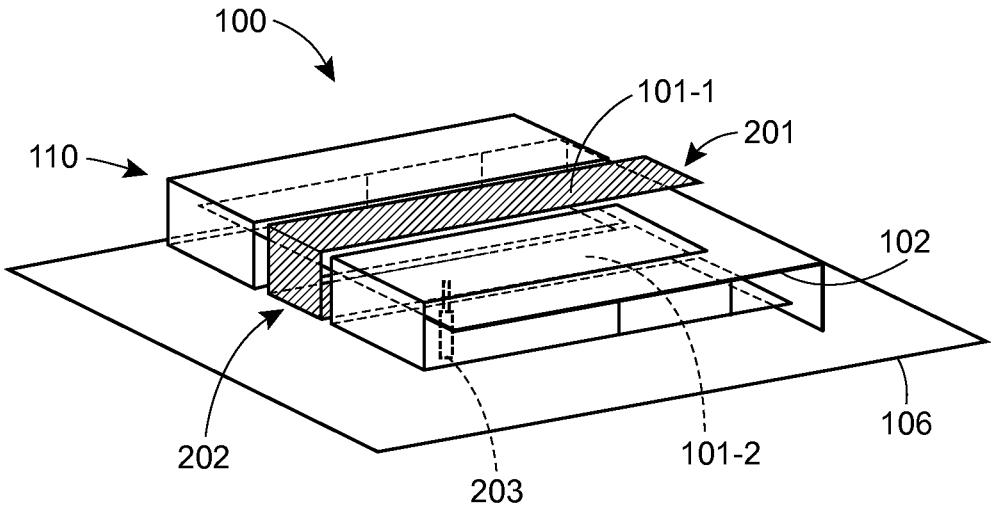
FIG. 2A is a perspective view illustrating the example broadband multi-strip antenna shown in FIGS. 1A and 1B wherein the driven strip, or main patch, is highlighted.
Figure 2B:
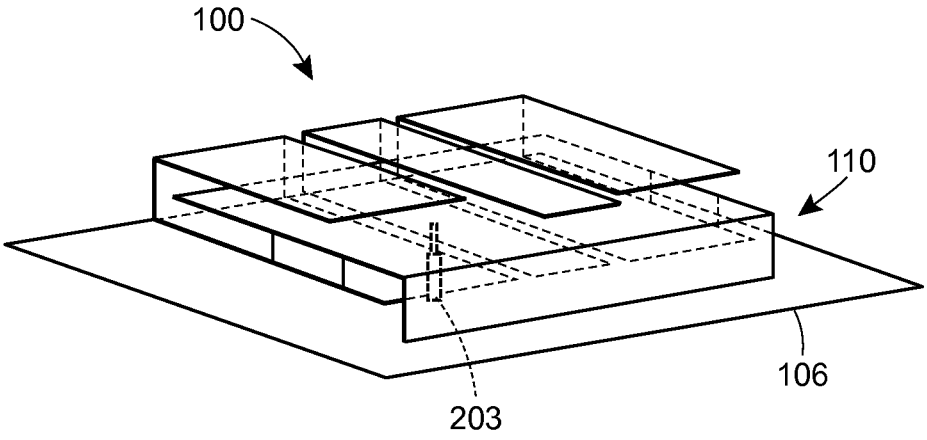
FIG. 2B is a perspective view illustrating the example broadband multi-strip antenna shown in FIGS. 1A and 1B wherein the feeding pin is highlighted.

In FIG. 2A, the main patch 101 of the antenna 100 includes a first, upper strip 101-1, having at least a portion disposed above the ground strip 102 and a second, lower strip 101-2, having at least a portion disposed below the ground strip 102. The main patch 101 has a width and a length and forms a pair of radiating edges with the ground strip 102 and the ground plane 106 at opposing sides of the main patch above and below the ground strip 102. More specifically, a first radiating edge 201 includes a first radiating slot 601 (shown in FIG. 6C) formed by the upper strip (or segment) 101-1 of the main patch 101 and the ground strip 102, and a second radiating edge 202 includes a second radiating slot 602 (shown in FIG. 6C) formed by the lower strip (or segment) 101-2 of the main patch 101 and the ground plane 106. Incorporating two radiating edges 201, 202 in the folded arrangement of the main patch 101, the ground strip 102, and the ground plane 106 increases radiation efficiency and reduces the quality factor (Q) of the antenna 100 as compared to a folded patch antenna assembly having one of its radiating edges shorted to ground. As a result, the dual radiating edges 201, 202 of the main patch 101 of the antenna 100 allows for a broader band impedance match to be achieved by the antenna 100, which leads to the broadband operation of the antenna 100.

As known, a patch antenna generally resonates at a frequency determined by the length of its driven patch, and the resonant length of the driven patch is approximately $\lambda_0/(2\sqrt{\in_r})$, where $\lambda_0$ is the free space wavelength of the lowest operating frequency of the antenna and $\in_r$ is the relative permittivity of the dielectric material between the patch and the ground plane or the ground strip. When the dielectric material is air, its $\in_r$ equals to 1. The length of the main patch 101 is therefore selected according to the lowest operating frequency of the desired operating frequency range of the antenna 100. However, due to the folded arrangement of the main patch 101, the overall length of the antenna element 110 may be reduced.

The width of a patch antenna generally affects the input impedance of the antenna and the dimension of the width may be selected to provide a good impedance match at the antenna input. Due in part to the coupling of the parasitic patches 103, 104 to the patch antenna 100, the width of the main patch 101 may be reduced for a particular desired bandwidth. The width of the main patch 101 may further be reduced through the implementation of the one or more tuning strips 105. Through the combination of one or more of these size reduction techniques, the width and length of the antenna block 110 may be reduced to approximately $\lambda_0/6$.

Figure 4A:
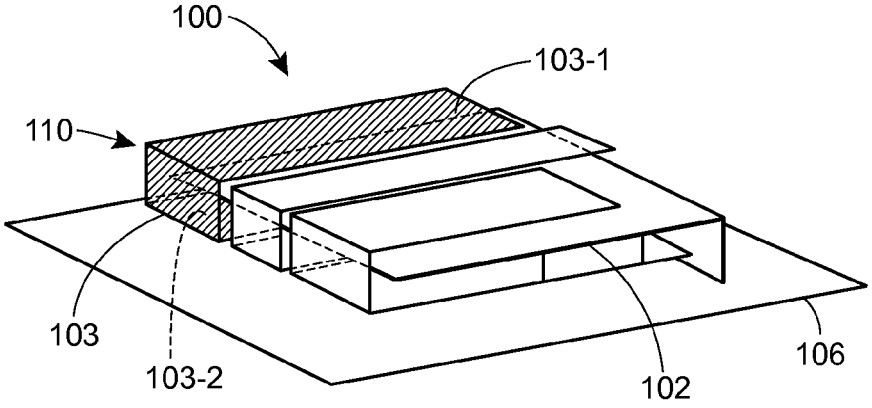
FIG. 4A is a perspective view illustrating the example broadband multi-strip antenna shown in FIGS. 1A and 1B wherein one of two parasitic patches is highlighted.
Figure 4B:
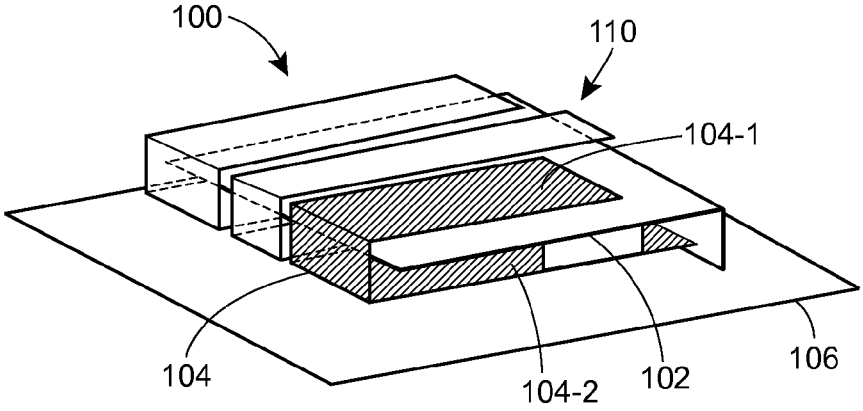
FIG. 4B is a perspective view illustrating the example broadband multi-strip antenna shown in FIGS. 1A, 1B, and 4A wherein the other of two parasitic patches is highlighted.

The parasitic patches 103, 104 are provided in the antenna 100 to enhance the broadband performance of the antenna 100. To this end, a length and a width for each of the parasitic patches 103, 104 are selected to achieve a suitable input impedance match for the antenna 100 in a suitably wide frequency band. Although the size of the antenna 100 will generally increase with the addition of the parasitic patches 103, 104, the size increase may be offset, at least partially, by using a folded arrangement of the parasitic patches 103, 104 similar to the folded arrangement of the main patch 101. Accordingly, each of the parasitic patches 103, 104 may be folded about the ground strip 102 as illustrated in FIGS. 4A and 4B. As shown in FIG. 4A, the first parasitic patch 103 includes a first, upper strip (or segment) 103-1 and a second, lower strip (or segment) 103-2. At least a portion of the upper strip 103-1 of the first parasitic patch 103 is disposed above the ground strip 102 and at least a portion of the lower strip 103-2 of the first parasitic patch 103 is disposed below the ground strip 102. Similarly, as shown in FIG. 4B, the second parasitic patch 104 includes a first, upper strip (or segment) 104-1 and a second, lower strip (or segment) 104-2. At least a portion of the upper strip 104-1 of the second parasitic patch 104 is disposed above the ground strip 102 and at least a portion of the lower strip 104-2 of the second parasitic patch 104 is disposed below the ground strip 102. It is to be noted that the antenna 100 is not limited to the two-parasitic patch implementation illustrated in FIGS. 1-6, and, in some embodiments, the antenna 100 may include any other suitable amount (e.g., 1, 3, 4, etc.) of parasitic patches. For example, either one of the parasitic patches 103, 104 may be omitted from the antenna 100.

Figure 5:
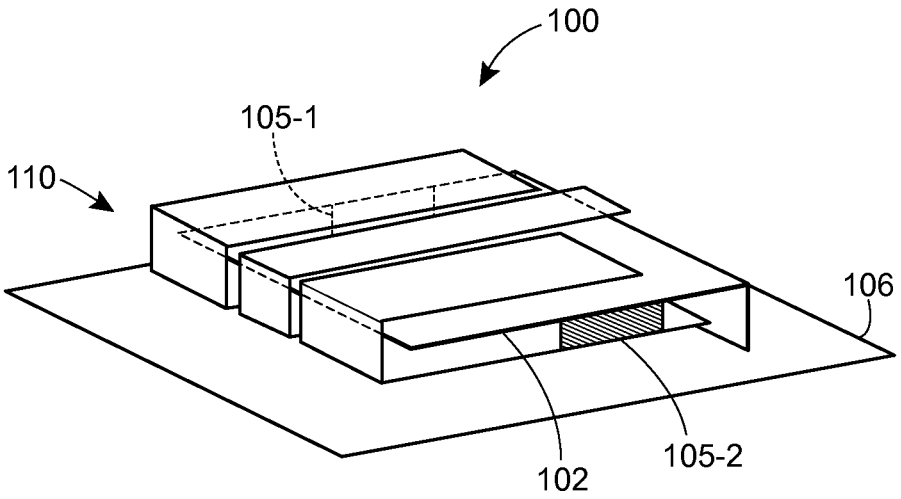
FIG. 5 is a perspective view illustrating the example broadband multi-strip antenna shown in FIGS. 1A and 1B wherein the tuning strip(s), or current modifying strip(s) is highlighted.

The tuning strips 105-1, 105-2 shown in FIG. 5 may be utilized to modify the distribution of electric current (or magnetic field) on the parasitic patches 103, 104 to further enhance broadband performance of the antenna 100. To this end, at least one tuning strip 105-1, 105-2 may be arranged such that a suitable impedance matching for the antenna 100 is achieved over a wider frequency range compared to the frequency range provided by non-modified current distribution on the parasitic patches 103, 104. As a result, the tuning strips 105-1, 105-2 further increase the fractional bandwidth of the antenna 100. To achieve a desired electrical current distribution on each of the parasitic patches 103, 104, the location and the width of each of the tuning strips 105-1, 105-2 are selected based on the standing wave current distribution on the corresponding parasitic patch 103, 104. By selecting a desired shorting location along the standing wave current pattern, and by controlling the length of the shorting element (i.e., the tuning strip 105-1, 105-2), current distribution is shaped in a controlled manner and a desired current distribution is thereby achieved. The location and the width of either of the tuning strips 105-1, 105-2 may be determined empirically and/or through the use of an electromagnetic analysis software tool. For example, the desired antenna bandwidth for the antenna 100 may be achieved by positioning each of the tuning strips 105-1, 105-2 near or nearer the vertical portion 102-2 of the ground strip 102 extending from the ground plane 106.

Figure 1B:
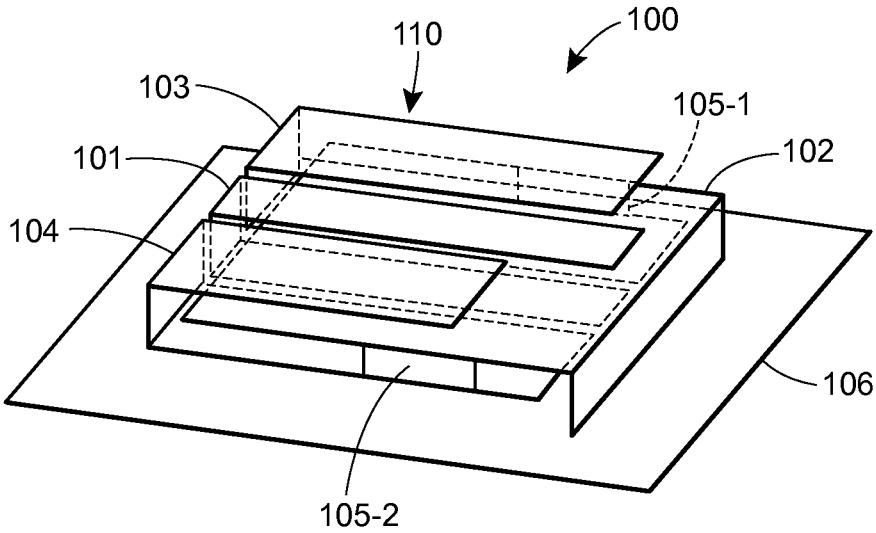
Figure 6A:
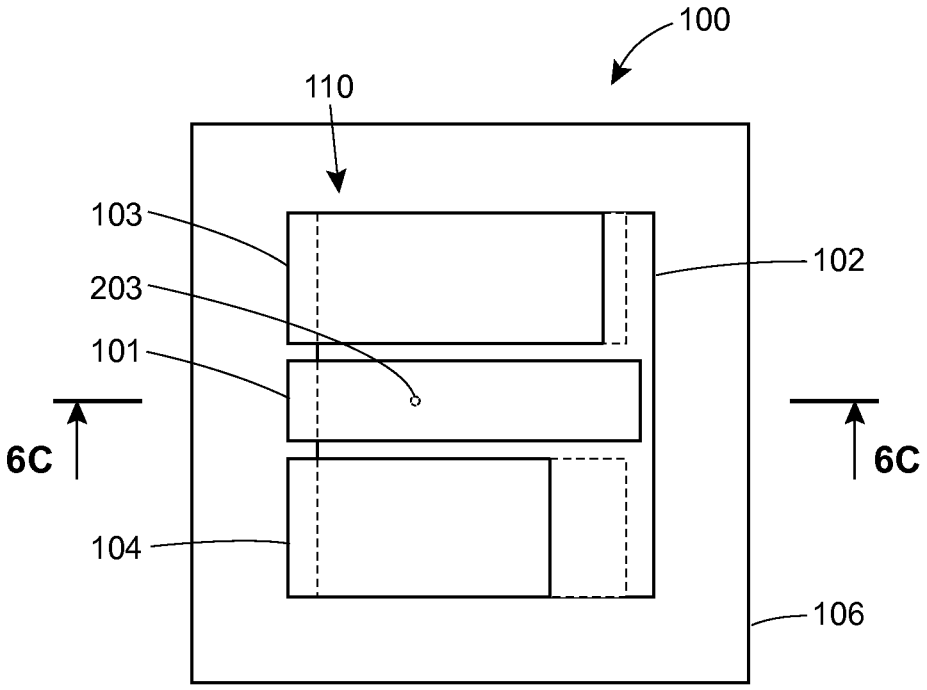
FIG. 6A is a plan view of the example broadband multi-strip antenna shown in FIGS. 1A and 1B.

FIG. 6A illustrates a plan view of the antenna 100 shown in FIGS. 1A and 1B. In particular, the lengths and the widths of the patches 101, 103, 104 need not be the same. For example, the length of each of the patches 101, 103, 104 may be selected such that each patch resonates at a slightly different frequency with respect to each other. Selecting different lengths for the patches 101, 103, 104 leads to a broader bandwidth of the antenna 100. As an example, the length of the first parasitic patch 103 may be slightly less than the length of the main patch 101, which may lead to a slightly higher resonant frequency of the first parasitic patch 103 relative to the resonant frequency of the main patch 101, thereby possibly extending the impedance bandwidth of the antenna 100 in a frequency band above the center operational frequency of the antenna 100. The length of the second parasitic patch 104, on the other hand, may be slightly greater than the length of the main patch 101, which may lead to a slightly lower resonant frequency of the second parasitic patch 104 relative to the resonant frequency of the main patch 101, thereby possibly extending the impedance bandwidth of the antenna 100 in a frequency band below the center operational frequency of the antenna 100. The widths of the patches 101, 103, 104 may also be selected to further optimize the impedance bandwidth by providing a suitable impedance match for the antenna 100 over a wider frequency band. It should be noted that the location of the feeding pin 203 may also be altered, providing an additional tuning parameter for achieving a desired broadband performance of the antenna 100.

Figure 6B:
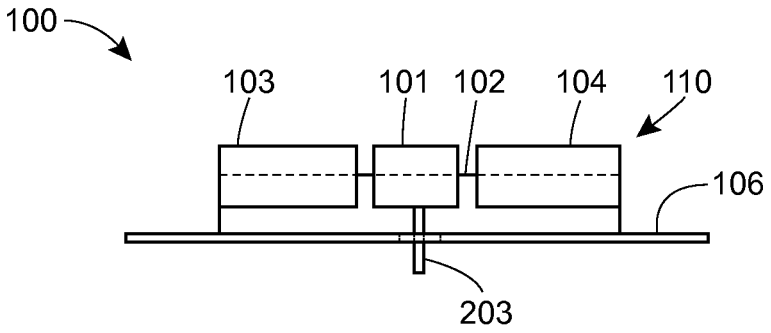
FIG. 6B is a left-side elevation view of the example antenna shown in FIG. 6A.
Figure 6C:
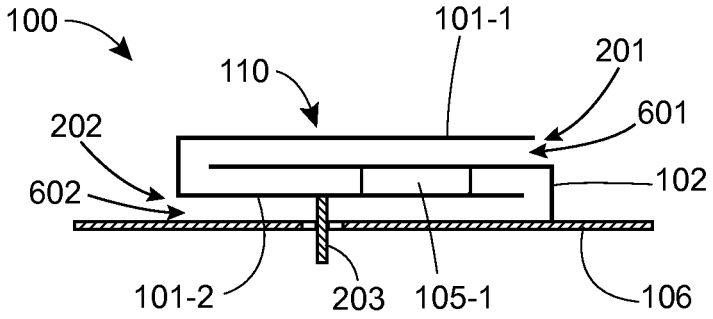
FIG. 6C is a front-side elevation view of the example antenna shown in FIG. 6A taken along cross-sectional line 6C-6C.
Figure 6D:
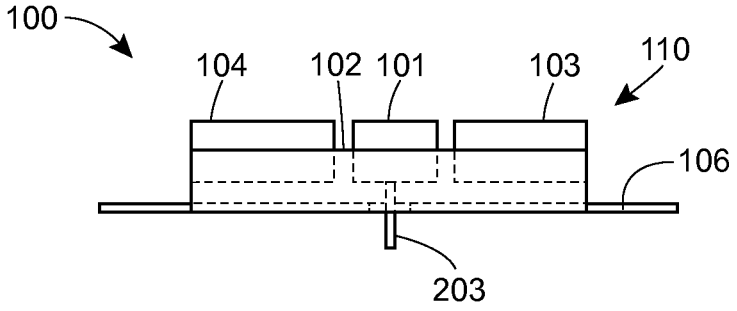
FIG. 6D is a right-side elevation view of the example antenna shown in FIG. 6A.

FIGS. 6B, 6C, and 6D illustrate, respectively, a left-side elevation view, a front-side cross-sectional elevation view, and a right-side elevation view of the antenna 100 shown in FIG. 6A. As can be seen in the cross-sectional view of FIG. 6C taken along lines 6C-6C of FIG. 6A, the first radiating edge 201 of the antenna 100 includes the first radiating slot 601 formed between the upper strip 101-1 of the main patch 101 and the ground strip 102, and the second radiating edge 202 of the antenna 100 includes the second radiating slot 602 formed between the lower strip 101-2 of the main patch 101 and the ground plane 106. When the length of the main patch 101 is approximately $\lambda_0/2$, the current and voltage distribution along the main patch 101 is such that the current at each of the radiating edges 201 and 202 is at approximately zero and the voltage is at a maximum.

In the layered arrangement illustrated in FIGS. 1-6, the upper strips 101-1, 103-1, 104-1 lie in a first plane in space and the lower strips 101-2, 103-2, 104-2 lie in a second plane in space. The horizontal portion 102-1 of the ground strip 102 lies in a third plane in space, and the ground plane 106 lies in a fourth plane in space. The first, second, third, and fourth planes are parallel with respect to each other, in the illustrated embodiment. As will be explained in more detail below in connection with FIGS. 9A-9C, in some embodiments, at least a portion of the second plane (i.e., the plane that includes the lower strips 101-2, 103-2, 104-2 of the patches 101, 103, 104) may be angled with respect to the first, third, and fourth planes, providing a gradual change or increase of separation between the ground plane 106 and the antenna block 110 in the angled portion of the antenna block 110. Providing such a gradual increase in separation between the antenna block 110 and the ground plane 106 may further increase the bandwidth of the antenna 100, in at least some configurations (see the discussion of FIGS. 9A-9C).

Figure 7A:
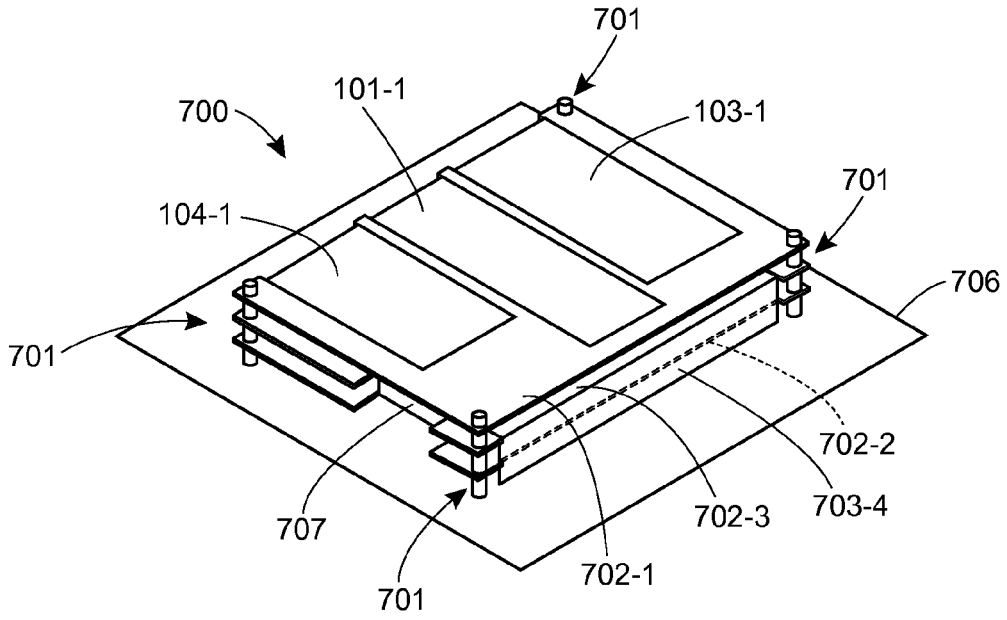
FIGS. 7A and 7B are perspective views of one example embodiment of a broadband multi-strip antenna.
Figure 7B:
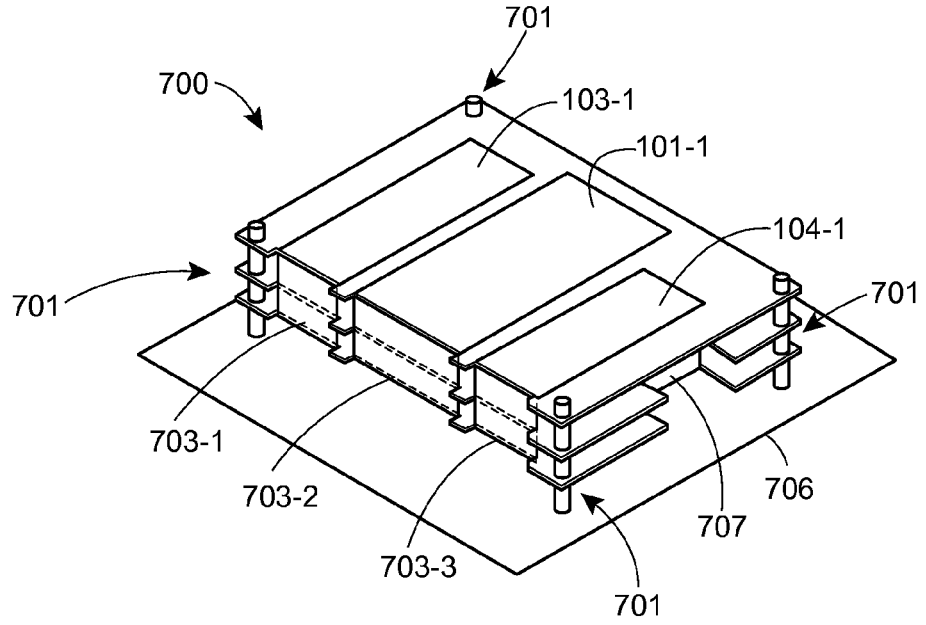

FIGS. 7A and 7B depict one embodiment of an antenna structure 700 utilizing printed circuit boards 702 to implement the antenna 100 of FIGS. 1-6. A first circuit board 702-1 includes the upper strip 101-1 of the main patch 101, the upper strip 103-1 of the first parasitic patch 103, and the upper strip 104-1 of the second parasitic patch 104. A second circuit board 702-2 includes the lower strip 101-2 of the main patch 101, the lower strip 103-2 of the first parasitic patch 103, and the lower strip 104-2 of the second parasitic patch 104. A third circuit board 702-3 includes the horizontal portion 102-1 of the ground strip 102. In combination, the circuit boards 702 form the antenna block 110 of the antenna 100. The circuit board 702-3 may comprise a sheet of suitable metal, such as copper or aluminum attached to a suitable non-conductive substrate, such as layered fiberglass epoxy FR4, for example. The patch strips 101, 103, and 104 may be printed on circuit boards 702-1 and 702-2, or generated on the circuit boards 702-1, 702-2 using any other suitable process, such as, for example, etching.

In the embodiment shown in FIG. 7A, the circuit boards 702 are mounted to the ground plane 706 using one or more, e.g., a set, of non-conductive screws and/or spacers 701 disposed between the layers of the antenna structure 700. For example, spacers 701 may be positioned near the corners of the circuit boards 702-1, 702-2, 702-3 between each layer of the antenna structure 700. An advantage of using spacers 701 for arranging the layers of the antenna structure 700 is that, in this arrangement, the separation between the layers can be easily and precisely controlled. Alternatively, another assembly process for the antenna structure 700 may use one or more non-conductive walls extending from the ground plane 706 to arrange the circuit boards 702. In such embodiments, one or more screws and/or spacers 701 may be omitted from the antenna structure 700.

Referring now to FIG. 7B, each of the upper strips 101-1, 103-1, 104-1 is coupled to the corresponding lower strip 101-2, 103-2, 104-2 with a respective connector 703. In particular, a connector 703-2 couples the upper strip 101-1 with the lower strip 101-2 of the main patch 101, a connector 703-1 couples the upper strip 103-1 with the lower strip 103-2 of the first parasitic patch 103, and a connector 703-3 couples the upper strip 104-1 with the lower strip 104-2 of the second parasitic patch 104. Similarly, a connector 703-4 couples the ground PCB 702-3 with the ground plane 706, as shown in FIG. 7A. If desired, one or more tuning strips 707 may be connected between the first parasitic patch 103 and the ground PCB 702-3 and/or the second parasitic patch 104 and the ground PCB 702-3.

Figure 8A:
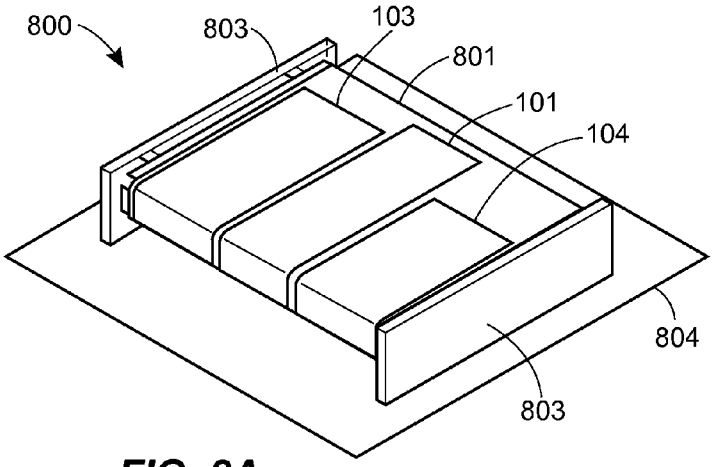
FIGS. 8A-8C are perspective views of another example embodiment of a broadband multi-strip antenna.
Figure 8B:
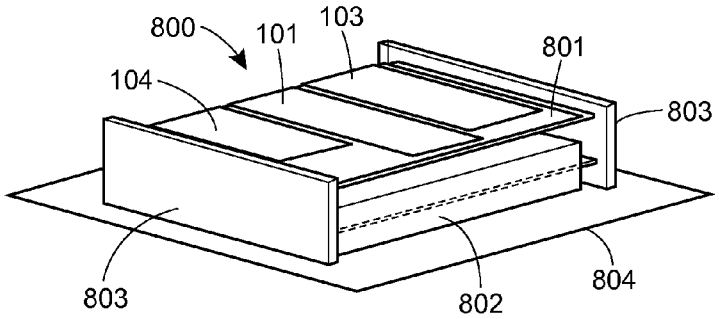
Figure 8C:
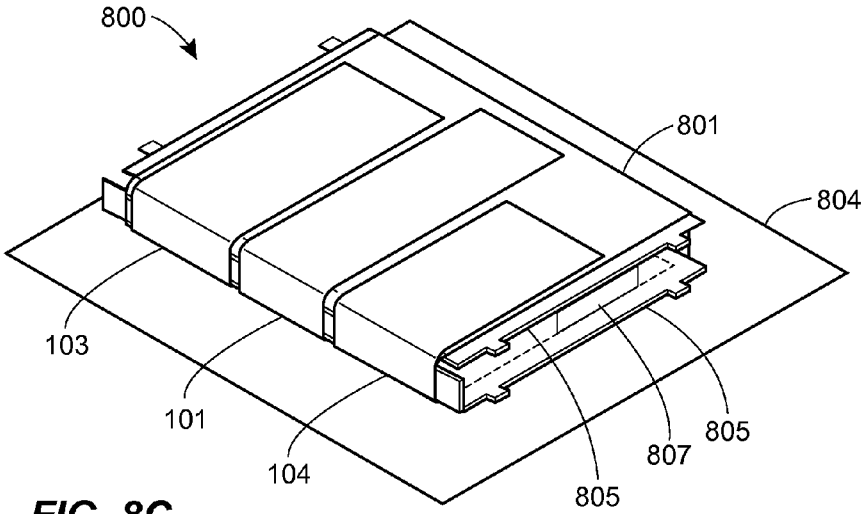

FIGS. 8A-8C depict an antenna structure 800 implementing the antenna 100 of FIG. 1-6, according to another embodiment, wherein the main patch 101, the first parasitic patch 103, and the second parasitic patch 104 are printed on a flexible circuit board 801. The flexible circuit board 801 is folded about a ground strip 802 which extends from or is connected to a ground plane 804. The folded flexible circuit board 801 and the ground strip 802 may be held in place with one or more non-conductive supports 803, for example, walls. In some embodiments, as illustrated in FIG. 8C, the antenna assembly 800 may also include one or more stiffeners 805 to produce a desired shape of the folded flexible circuit board 801. If desired, one or more tuning strips 807 may be connected between the first parasitic patch 103 and the ground strip 802 and/or the second parasitic patch 104 and the ground strip 802. Using a flexible circuit board instead of two separate boards for the lower and the upper strips generally simplifies the manufacturing process of the antenna 100 by eliminating the need to separately connect respective lower and upper strips of the antenna patches 101, 103, and 104.

Figure 9A:
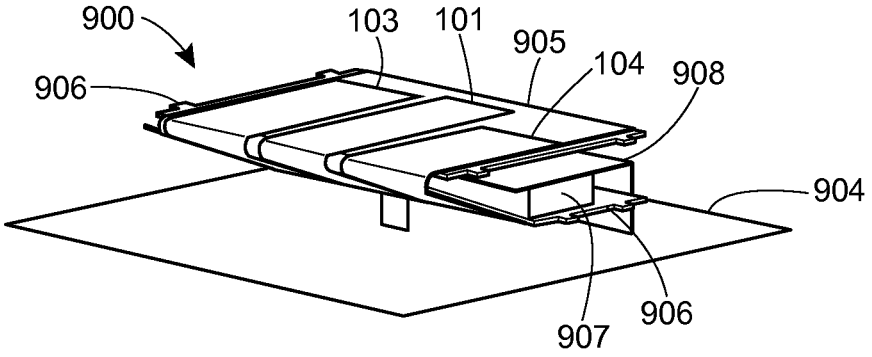
FIGS. 9A-9C are various views of another example embodiment of a broadband multi-strip antenna.
Figure 9B:
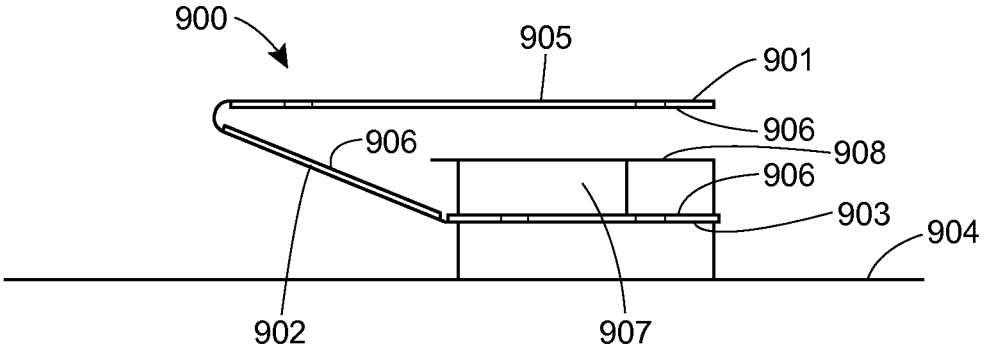
Figure 9C:
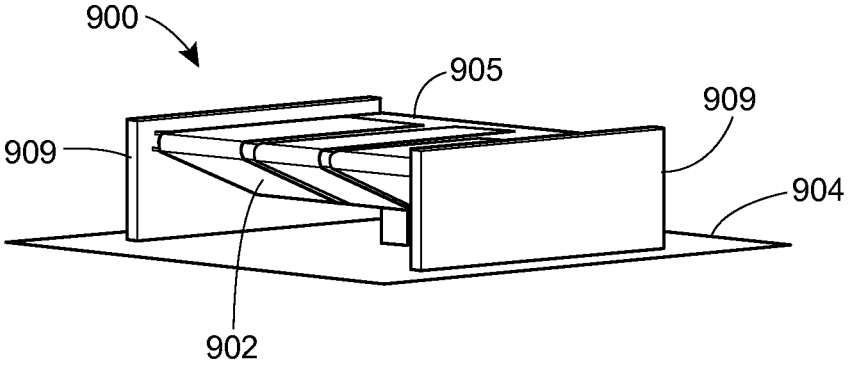

FIGS. 9A-9C depict another embodiment of an antenna structure 900 implementing the antenna 100 of FIG. 1-6, wherein the main patch 101, the first parasitic patch 103, and the second parasitic patch 104 are printed on a flexible circuit board 905. The flexible circuit board 905 is folded about the ground strip 908 which extends from or is connected to the ground plane 904. The folded flexible circuit board 905 and the ground strip 908 may be held in place with one or more non-conductive supports 909, for example, walls. In some embodiments, the antenna assembly 900 may also include one or more stiffeners 906 to produce a desired shape of the folded flexible circuit board 905. If desired, one or more tuning strips 907 may be connected between the first parasitic patch 103 and the ground strip 908 and/or the second parasitic patch 104 and the ground strip 908.

In the antenna structure 900, at least a portion of the upper strip of the main patch 101 and at least a portion of the upper strips of the first and second parasitic patches 103, 104 of the flexible circuit board 905 lie in a first plane 901 in space. At least a portion of the lower strip of the main patch 101 and at least a portion of the lower strips of the first and second parasitic patches 103, 104 of the flexible circuit board 905 lie in a second plane 902 and a third plane 903, in space. The second plane 902 is not parallel to the first plane 901 or the ground plane 904. Accordingly, in this arrangement, the distance between the ground plane 904 and the non-parallel portion of the patch antenna element lying within the second plane 902 (as well as the portions of the lower strips 101-2, 103-2, 104-2 of the respective patches 101, 103, 104) is gradually increased in one direction. Increasing the ground separation generally improves radiation efficiency of the antenna, thereby decreasing the Q factor of the antenna and broadening the bandwidth of the antenna. Thus, gradual increase of the degree of separation between the ground plane 904 and the lower strips 101-2, 103-2, 104-2 of the respective patches 101, 103, 104 included within the non-parallel portion of the flexible circuit board 905 lying within the second plane 902 increases the bandwidth of the antenna without increasing the overall antenna height. It should be noted that the gradual separation feature in the antenna 900 is not limited to a flexible circuit board implementation and can be implemented in any other suitable manner (e.g., using several non-flexible circuit boards).

It can be appreciated from the description above that the antenna's operational frequency characteristics, in particular, the bandwidth, may be adjusted by performing one or more of the following steps: attaching a tuning strip between the parasitic patch and the ground strip; changing a size of the tuning strip; changing a position of the tuning strip between the parasitic patch and the ground strip; changing a position of a feeding pin; directly coupling the main patch to the parasitic patch; gap-coupling the main patch to the parasitic patch; adjusting a spatial relationship between a gap-coupled main patch and parasitic patch; maintaining a constant spatial relationship between the first strip of the main patch and the second strip of the main patch; maintaining a constant spatial relationship between the first strip of the parasitic patch and the second strip of the parasitic patch; varying a spatial relationship between at least a portion of the first strip of the main patch and at least a portion of the second strip of the main patch; varying a spatial relationship between at least a portion of the first strip of the parasitic patch and at least a portion of the second strip of the parasitic patch; varying a spatial relationship between at least a portion of the second strip of the main patch and a ground plane, modifying a length of the main patch to be different in comparison to a length of the parasitic patch; and modifying a width of the main patch to be different in comparison to a width of the parasitic patch.

Table 1000 in FIG. 10 shows a comparison of the size of antenna 100 relative to a conventional single resonator patch antenna at several operating frequencies according to several embodiments. As can be seen from table 1000, a significant reduction in size relative to the size of a conventional patch antenna is achieved by utilizing the techniques described herein.

Table 1100 in FIG. 11 shows a comparison of antenna performance of the antenna 100 relative to a conventional single resonator patch antenna at several operating frequencies, according to several embodiments. Table 1100 shows that the gain, directivity, and mismatch loss of the antenna 100, although slightly degraded, are still comparable with the corresponding parameters of a conventional single resonator patch antenna, making the antenna 100 suitable for many applications that require or can benefit from the reduced size of the antenna 100.

Figure 12:
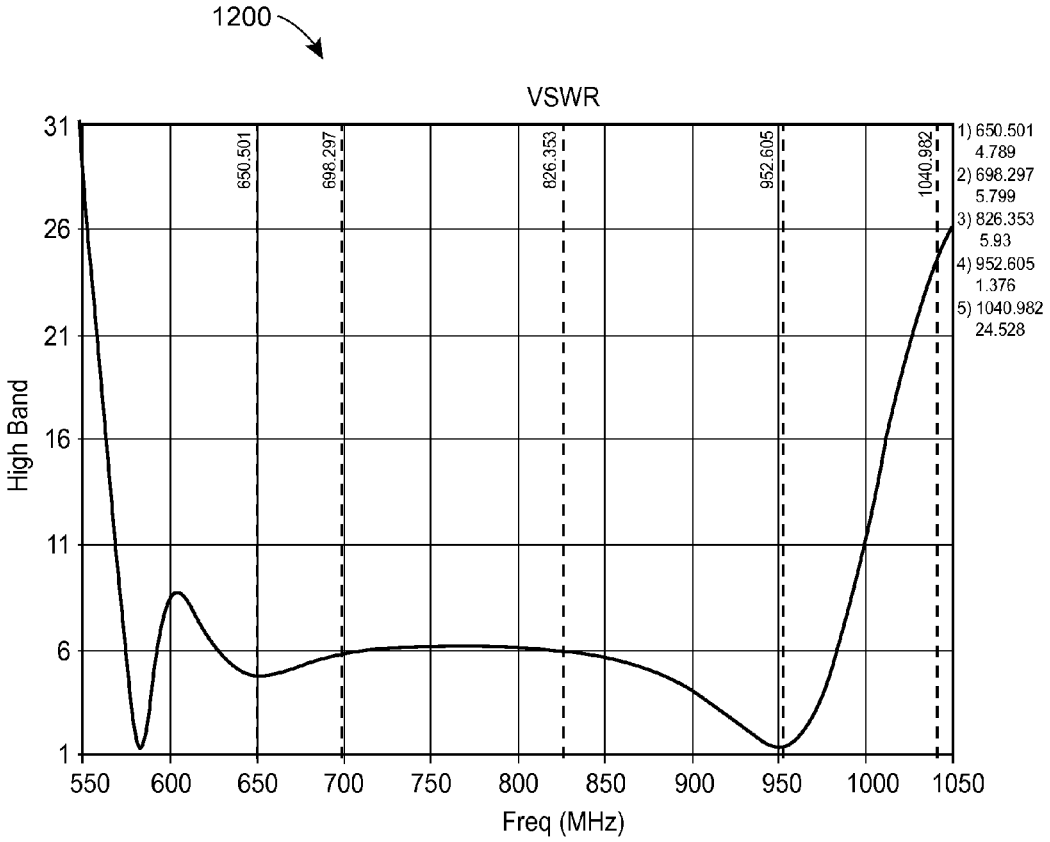
FIG. 12 is a graph of voltage standing wave ratio (VSWR) versus frequency for an example broadband multi-strip antenna.

FIG. 12 is a voltage standing wave ratio (VSWR) graph 1200 showing VSWR versus frequency for an example embodiment of the antenna 100. Graph 1200 shows that a suitable input impedance match (VSWR<6) is achieved over a fractional bandwidth of approximately 40%, in the illustrated embodiment.

Figure 13:
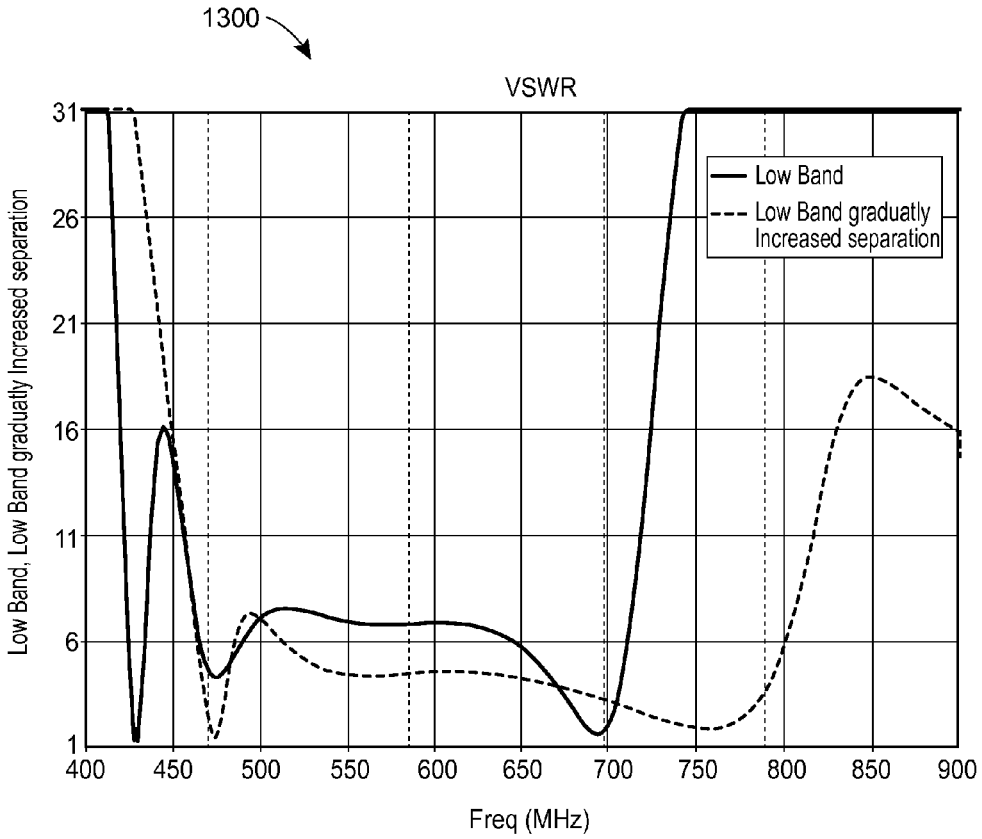
FIG. 13 is a graph of VSWR versus frequency illustrating effects of a gradual increase in ground plane separation for an example broadband multi-strip antenna.

FIG. 13 is a graph 1300 of VSWR versus frequency for two example embodiments of the antenna, i.e., with and without a gradual increase in ground plane separation (discussed above in connection to FIGS. 9A-9C). In the graph 1300, VSWR for an example antenna without gradual ground plane separation is indicated by the solid line, while an example antenna having gradual separation from ground plane is indicated by the dashed line. As can be seen from the graph 1300, the dashed line shows a low VSWR (e.g., <6) region spanning a larger frequency band compared to the frequency band spanned by a low VSWR (e.g., <6) region indicated by the solid line. Accordingly, graph 1300 shows that antenna bandwidth is enhanced when a gradual increase in ground plane separation is introduced.

Figure 14A:
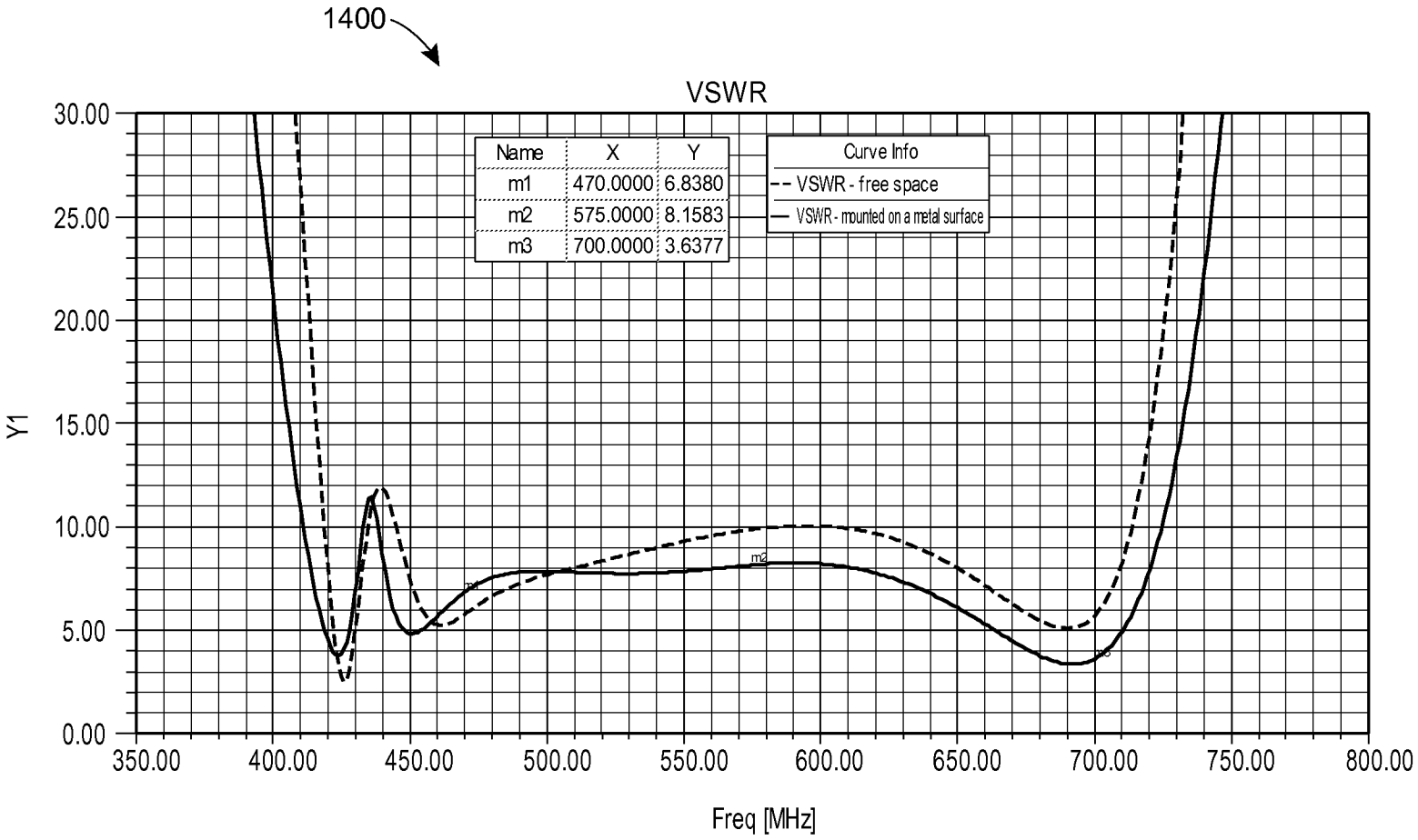
FIG. 14A is a graph of VSWR versus frequency for an example antenna in free space and for the example antenna mounted on a metal surface.
Figure 14B:
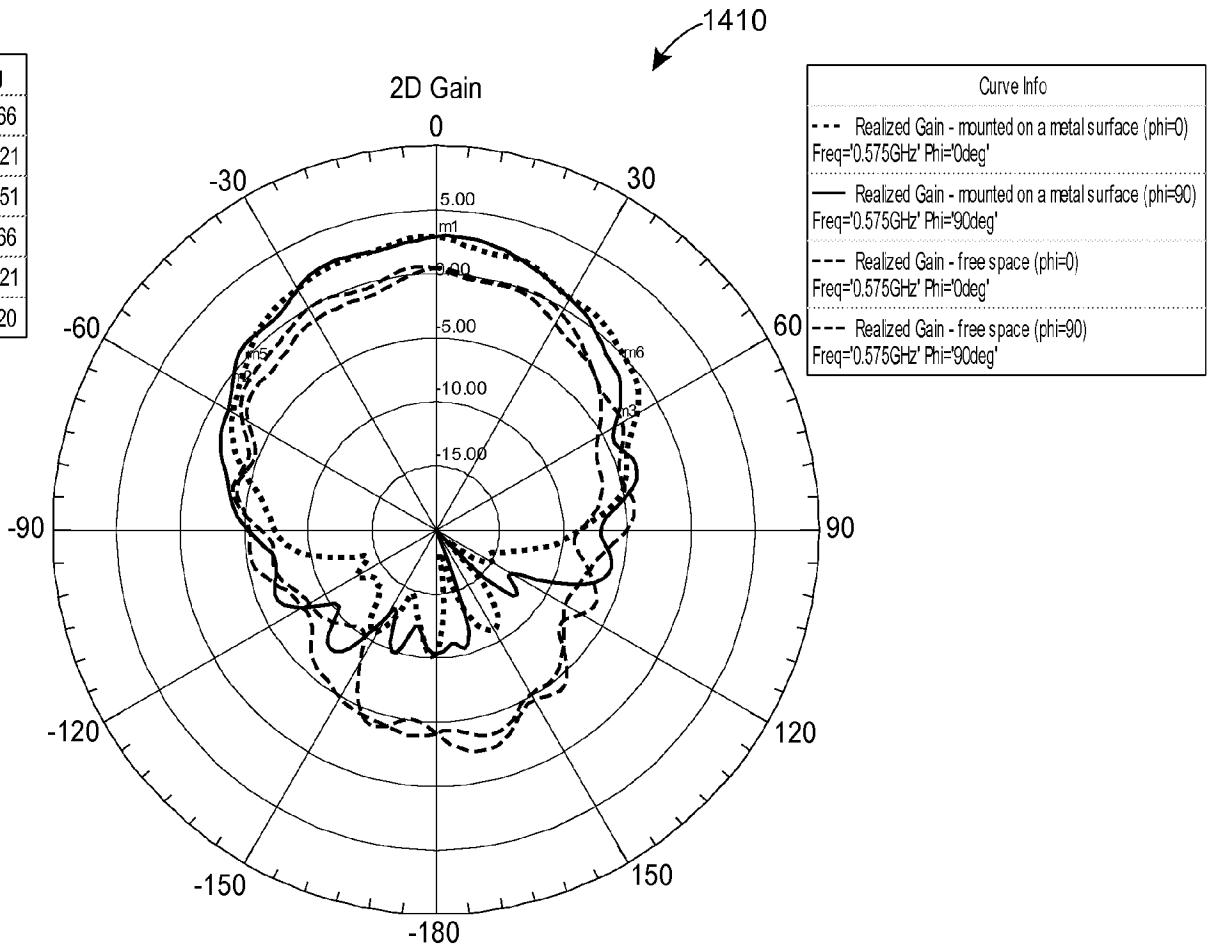
FIG. 14B is a polar chart of radiation patterns for the example antenna of FIG. 14A operating in free space and for the example antenna mounted on a metal surface.

FIGS. 14A and 14B depict a VSWR plot 1400 and a polar chart 1410 of radiation pattern, respectively, comparing an example antenna operating in free space with the same example antenna mounted on a metal surface, according to an embodiment In the embodiment depicted in FIGS. 14A and 14B, the example antenna operates in a relatively low frequency range in the ultra-high frequency (UHF) band, with an operation frequency range of approximately 470 MHz-790 MHz. In FIGS. 14A and 14B, the dashed lines correspond to an example antenna operating in free space, while the solid lines correspond to the same example antenna, but mounted on a large metal surface. As can be seen from plots 1400 and 1410, the mounting surface does not have a significant effect on the performance of the antenna.

Figure 15A:
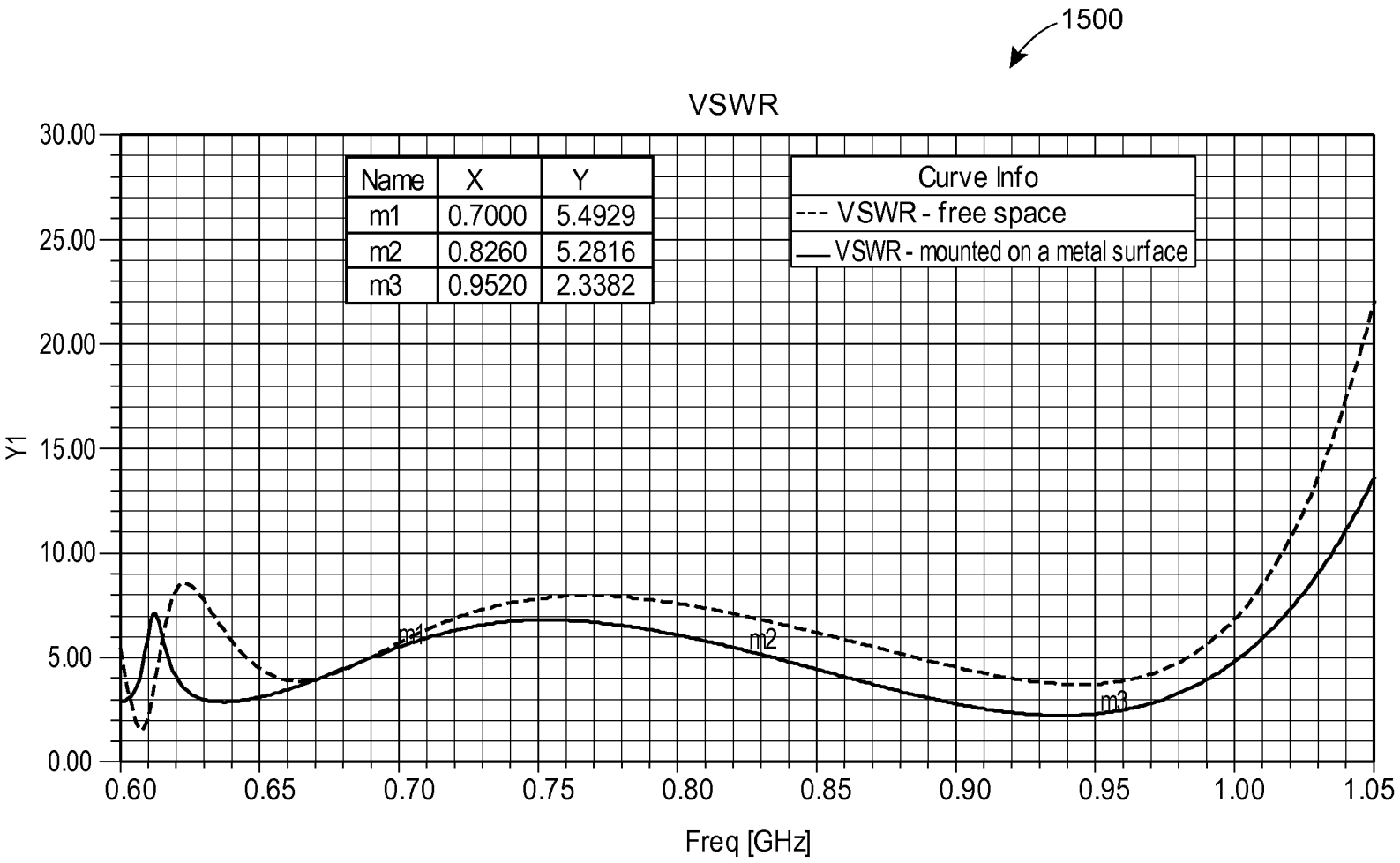
FIG. 15A is a graph of VSWR versus frequency for another example antenna assembled in accordance with the teachings of the present invention operating in free space and for the example antenna mounted on a metal surface.
Figure 15B:
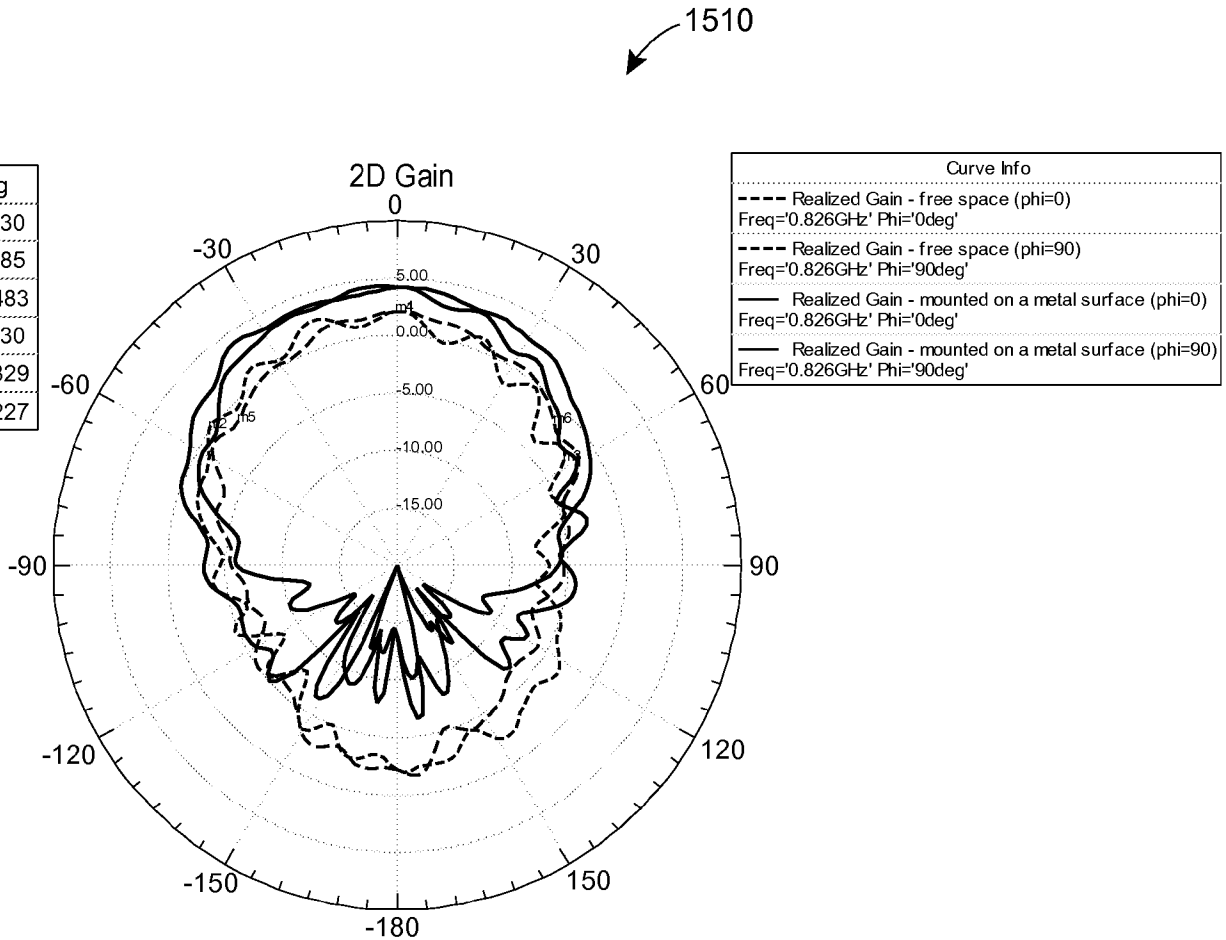
FIG. 15B is a polar chart of radiation patterns for the example antenna of FIG. 15A operating in free space and for the example antenna mounted on a metal surface.

FIGS. 15A and 15B depict a VSWR plot 1500 and a polar chart 1510 of radiation pattern, respectively, comparing an example antenna operating in free space with the same example antenna mounted on a metal surface, according to another embodiment. In the embodiment depicted in FIGS. 15A and 15B, the example antenna operates in a relatively high frequency range in the UHF frequency band, with an operation frequency range of approximately 680 MHz-980 MHz. In FIGS. 15A and 15B, the dashed lines correspond to an example antenna operating in free space, while the solid lines correspond to the same example antenna, but mounted on a large metal surface. As can be seen from plots 1500 and 1510, the mounting surface does not have a significant effect on the performance of the antenna operating in the higher frequency range.

The configurations and techniques described above provide several tuning options for reducing the size of a patch antenna as well as increasing the bandwidth, such as, using a folded main patch with two radiating edges, gap-coupling a parasitic patch to the main patch along at least a portion of a non-radiating edge of the main patch, using one or more tuning strips to couple one or more parasitic patches to the ground strip, gradually increasing the separation between the main and the parasitic patch(es) and the ground plane, and modifying the length and width of the main patch and one or more parasitic patches. Through the use of one or more of these tuning options, an improved patch antenna having a 40% fractional bandwidth and a 50% size reduction in all dimensions over current patch antennas was able to be attained. Such a patch antenna is suitable for short to medium range wireless communication systems, for example, wireless microphones, wireless audio monitoring systems, local wireless data networks, and wireless medical devices. In addition, the low profile, significantly reduced size, and insensitivity to mounting surfaces makes the antenna of the present invention compatible for permanent indoor installations.

While the disclosed methods and apparatus have been described with reference to specific examples, which are intended to be illustrative only and not to be limiting of the invention, it will be apparent to those of ordinary skill in the art that changes, additions or deletions may be made to the disclosed embodiments without departing from the spirit and scope of the invention. This patent therefore covers all methods, apparatus and articles of manufacture fairly falling within the scope of the appended claims either literally or under the doctrine of equivalents.

What is claimed is:

1. An antenna assembly comprising:

a ground plane;

a ground strip extending from the ground plane;

a main patch including a first strip and a second strip, at least a portion of the first strip of the main patch disposed above the ground strip and forming a first radiating edge with the ground strip, and at least a portion of the second strip of the main patch disposed below the ground strip and forming a second radiating edge with the ground plane; and a parasitic patch disposed adjacent to and coplanar with the main patch, the parasitic patch coupled to the main patch along at least a portion of a non-radiating edge of the main patch, the parasitic patch including a first strip and a second strip, at least a portion of the first strip of the parasitic patch disposed above the ground strip and at least a portion of the second strip of the parasitic patch disposed below the ground strip.

2. The antenna assembly of claim 1, further comprising a tuning strip directly coupled to the parasitic patch and the ground strip.

3. The antenna assembly of claim 1, wherein the at least a portion of the first strip of the main patch and the at least a portion of the first strip of the parasitic patch lie in a first plane, and the at least a portion of the second strip of the main patch and the at least a portion the second strip of the parasitic patch lie in a second plane, wherein the first plane and the second plane are different.

4. The antenna assembly of claim 3, wherein the first plane is parallel to the second plane.

5. The antenna assembly of claim 3, wherein the first plane is not parallel to the second plane.

6. The antenna assembly of claim 1, wherein:

the main patch has a length and a width; and the parasitic patch has a length and a width, wherein the length of the main patch is different than the length of the parasitic patch.

7. The antenna assembly of claim 6, wherein:

the width of the main patch is different than the width of the parasitic patch.

8. The antenna assembly of claim 1, wherein:

the main patch has a length and a width; and the parasitic patch has a length and a width, wherein the width of the main patch is different than the width of the parasitic patch.

9. The antenna assembly of claim 1, wherein the parasitic patch is a first parasitic patch and the non-radiating edge is a first non-radiating edge, the antenna assembly further comprising:

a second parasitic patch disposed adjacent to and coplanar with the main patch, the second parasitic patch coupled to the main patch along at least a portion of a second non-radiating edge of the main patch, the second parasitic patch including a first strip and a second strip, at least a portion of the first strip of the second parasitic patch disposed above the ground strip and at least a portion of the second strip of the second parasitic patch disposed below the ground strip.

10. The antenna assembly of claim 9, further comprising:

a first tuning strip directly coupled to the first parasitic patch and the ground strip; and a second tuning strip directly coupled to the second parasitic patch and the ground strip.

11. The antenna assembly of claim 10, wherein the at least a portion of the first strip of the main patch, the at least a portion of the first strip of the first parasitic patch, and the at least a portion of the first strip of the second parasitic strip lie in a first plane, and the at least a portion of the second strip of the main patch, the at least a portion the second strip of the first parasitic patch, and the at least a portion of the second strip of the second parasitic patch lie in a second plane, wherein the first plane and the second plane are different.

12. The antenna assembly of claim 11, wherein the first plane is parallel to the second plane.

13. The antenna assembly of claim 11, wherein the first plane is not parallel to the second plane.

14. The antenna assembly of claim 9, wherein the main patch has a length and a width;

the first parasitic patch has a length and a width;

the second parasitic patch has a length and a width; and wherein the length of the main patch, the length of the first parasitic patch, and the length of the second parasitic patch are different.

15. The antenna assembly of claim 14, wherein the width of the main patch, the width of the first parasitic patch, and the width of the second parasitic patch are different.

16. The antenna assembly of claim 9, wherein the main patch has a length and a width; the first parasitic patch has a length and a width; the second parasitic patch has a length and a width; and wherein the width of the main patch, the width of the first parasitic patch, and the width of the second parasitic patch are different.

17. The antenna assembly of claim 1, further comprising:

a flexible printed circuit board including the main patch and the parasitic patch, the flexible printed circuit board folded about the ground strip;

a stiffener to support the flexible circuit board folded about the ground strip; and at least one support, wherein the stiffener is attached to the support.

18. The antenna assembly of claim 1, further comprising:

a first printed circuit board including the first strip of the main patch and the first strip of the parasitic patch;

a second printed circuit board including the ground strip;

a third printed circuit board including the second strip of the main patch and the second strip of the parasitic patch;

a first connector coupling the first strip of the main patch to the second strip of the main patch;

a second connector coupling the first strip of the parasitic patch to the second strip of the parasitic patch; and at least one spacer disposed between the first printed circuit board, the second printed circuit board, and the third printed circuit board.

19. The antenna assembly of claim 1, wherein the parasitic patch is gap-coupled to the main patch along at least a portion of the non-radiating edge of the main patch.

20. The antenna assembly of claim 1, wherein the main patch is electrically isolated from the ground plane.

21. An antenna assembly comprising:

a ground plane;

a ground strip extending from the ground plane;

a main patch including a first strip and a second strip, at least a portion of the first strip of the main patch disposed above the ground strip and forming a first radiating edge with the ground strip, and at least a portion of the second strip of the main patch disposed below the ground strip and forming a second radiating edge with the ground plane;

a first parasitic patch disposed adjacent to and coplanar with the main patch, the first parasitic patch coupled to the main patch along at least a portion of a first non-radiating edge of the main patch, the first parasitic patch including a first strip and a second strip, at least a portion of the first strip of the first parasitic patch disposed above the ground strip and at least a portion of the second strip of the first parasitic patch disposed below the ground strip;

a second parasitic patch disposed adjacent to and coplanar with the main patch, the second parasitic patch coupled to the main patch along at least a portion of a second non-radiating edge of the main patch, the second parasitic patch including a first strip and a second strip, at least a portion of the first strip of the second parasitic patch disposed above the ground strip and at least a portion of the second strip of the second parasitic patch disposed below the ground strip;

the at least a portion of the first strip of the main patch, the at least a portion of the first strip of the first parasitic patch, and the at least a portion of the first strip of the second parasitic patch lie in a first plane, and the at least a portion of the second strip of the main patch, the at least a portion of the second strip of the first parasitic patch, and the at least a portion of the second strip of the second parasitic patch lie in a second plane, wherein the first plane is different than the second plane;

a first tuning strip directly coupled to the first parasitic patch and the ground strip; and a second tuning strip directly coupled to the second parasitic patch and the ground strip.

22. The antenna assembly of claim 21, wherein the first plane is not parallel to the second plane.

23. The antenna assembly of claim 21, wherein:

the main patch has a length and a width;

the first parasitic patch has a length and a width; and the second parasitic patch has a length and a width, wherein the lengths of the main patch, the first parasitic patch, and the second parasitic patch are different, and the widths of the main patch, the first parasitic patch, and the second parasitic are different.

24. The antenna assembly of claim 21, wherein the first parasitic patch is gap-coupled to the main patch along the at least a portion of the first non-radiating edge of the main patch and the second parasitic patch is gap-coupled to the main patch along the at least a portion of the second non-radiating edge of the main patch.

25. The antenna assembly of claim 21, wherein the main patch is electrically isolated from the ground plane.

26. A method for providing an antenna for a wireless system, the method comprising:

providing a ground strip, the ground strip extending from a ground plane;

providing a main patch including a first strip and a second strip;

positioning the main patch about the ground strip, wherein at least a portion of the first strip of the main patch positioned above the ground strip and forming a first radiating edge with the ground strip, and at least a portion of the second strip of the main patch positioned below the ground strip and forming a second radiating edge with the ground plane;

disposing a parasitic patch adjacent to and coplanar with the main patch; and coupling the parasitic patch to the main patch along at least a portion of a non-radiating edge of the main patch, wherein the parasitic patch including a first strip and a second strip, at least a portion of the first strip of the parasitic patch positioned above the ground strip and at least a portion of the second strip of the parasitic patch positioned below the ground strip.

27. The method of claim 26, further comprising adjusting a bandwidth of the antenna by performing one or more of the following steps:

attaching a tuning strip between the parasitic patch and the ground strip;

changing a size of the tuning strip;

changing a position of the tuning strip between the parasitic patch and the ground strip;

changing a position of a feeding pin;

directly coupling the main patch to the parasitic patch;

gap-coupling the main patch to the parasitic patch;

adjusting a spatial relationship between a gap-coupled main patch and parasitic patch;

maintaining a constant spatial relationship between the first strip of the main patch and the second strip of the main patch;

varying a spatial relationship between the at least a portion of the first strip of the main patch and the at least a portion of the second strip of the main patch;

varying a spatial relationship between the at least a portion of the first strip of the parasitic patch and the at least a portion of the second strip of the parasitic patch;

varying a spatial relationship between at least a portion of the second strip of the main patch and a ground plane;

modifying a width of the main patch to be different in comparison to a width of the parasitic patch; and modifying a length of the main patch to be different in comparison to a length of the parasitic patch.

28. The method of claim 26, wherein the parasitic patch is a first parasitic patch and the non-radiating edge is a first non-radiating edge, the method further comprising:

disposing a second parasitic patch adjacent to and coplanar with the main patch; and coupling the second parasitic patch to the main patch along at least a portion of a second non-radiating edge of the main patch, wherein the second parasitic patch includes a first strip and a second strip, at least a portion of the first strip of the second parasitic patch is positioned above the ground strip and at least a portion of the second strip of the second parasitic patch positioned below the ground strip.

29. The method of claim 28, wherein coupling a first parasitic patch to the main patch includes gap-coupling the first parasitic patch to the main patch along the at least a portion of the first non-radiating edge of the main patch, and coupling a second parasitic patch to the main patch includes gap-coupling the second parasitic patch to the main patch along the at least a portion of second non-radiating edge of the main patch.

30. The method of claim 26, wherein the main patch is electrically isolated from the ground plane.

* * * * *